US007549542B2

(12) United States Patent
Gasior et al.

(10) Patent No.: US 7,549,542 B2
(45) Date of Patent: Jun. 23, 2009

(54) SHIPPER CONTAINER AND TRANSFER TOOL AND SYSTEM AND METHOD FOR USE THEREOF

(75) Inventors: Wayne P. Gasior, Duluth, GA (US); Tracy C. Smith, Stone Mountain, GA (US); Michael J. Huggins, Dillon, SC (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 623 days.

(21) Appl. No.: 11/247,386

(22) Filed: Oct. 11, 2005

(65) Prior Publication Data

US 2006/0091040 A1 May 4, 2006

Related U.S. Application Data

(60) Provisional application No. 60/622,974, filed on Oct. 28, 2004.

(51) Int. Cl.

| | |
|---|---|
| ***B65D 79/00*** | (2006.01) |
| ***B65D 75/58*** | (2006.01) |
| ***B65D 25/04*** | (2006.01) |
| ***B65D 17/00*** | (2006.01) |

(52) U.S. Cl. ..... 206/746; 206/739; 229/120.08; 229/235

(58) Field of Classification Search ..... 206/736, 206/738, 739, 746, 229; 229/120.08–120.21, 229/200, 235, 240–244

See application file for complete search history.

(56) References Cited

U.S. PATENT DOCUMENTS

| | | | | |
|---|---|---|---|---|
| 2,835,594 A | | 5/1958 | Felt et al. | |
| 2,864,548 A | | 12/1958 | Zastrow | |
| 2,943,743 A | | 7/1960 | Thorson | |
| 3,199,762 A | | 8/1965 | Coons | |
| 3,211,293 A | | 10/1965 | Tarnoff | |
| 3,313,407 A | * | 4/1967 | Palm, Jr. | 206/526 |
| 3,621,996 A | * | 11/1971 | Seyer | 206/463 |
| 4,058,206 A | * | 11/1977 | Morse et al. | 229/241 |
| 4,111,297 A | | 9/1978 | Paulin | |
| 4,113,100 A | * | 9/1978 | Soja et al. | 229/112 |

(Continued)

FOREIGN PATENT DOCUMENTS

DE 299 01 874 U1 4/1999

OTHER PUBLICATIONS

International Search Report PCT/US2005/036318.

(Continued)

*Primary Examiner*—J. Gregory Pickett
(74) *Attorney, Agent, or Firm*—Joel T. Charlton

(57) ABSTRACT

The transfer tool of this invention includes a handle, a substantially rigid rod extending from the handle, and a peg attachment end. The rod should be long enough to hold a plurality of packages to facilitate the quick transfer of a large number of packages from the shipping container to the display peg. The peg attachment end is configured to temporarily abut and align with the end of the display peg extending from the display case. Specially designed shipping containers are used to orient the packages in alignment to facilitate transfer of the packages to the display peg with the transfer tool A system and method of using the transfer tool and shipping container of this invention are also disclosed.

15 Claims, 13 Drawing Sheets

U.S. PATENT DOCUMENTS

| | | | | |
|---|---|---|---|---|
| 4,143,772 | A | 3/1979 | Bona | |
| 4,301,575 | A | 11/1981 | Goldberg | |
| 4,651,918 | A * | 3/1987 | Moore et al. | 229/120.18 |
| 5,054,727 | A | 10/1991 | Campbell et al. | |
| 5,579,927 | A | 12/1996 | Thompson et al. | |
| 5,607,058 | A | 3/1997 | Huesman et al. | |
| 5,632,387 | A | 5/1997 | Johnson | |
| 5,901,860 | A | 5/1999 | Nowicki | |
| 6,129,211 | A * | 10/2000 | Prakken et al. | 206/750 |
| 6,446,819 | B1 | 9/2002 | Mattesky | |
| 6,478,159 | B1 * | 11/2002 | Taylor et al. | 206/738 |
| 6,704,971 | B2 | 3/2004 | Dossett et al. | |
| 6,726,428 | B1 | 4/2004 | Canepari | |
| 2003/0000052 | A1 | 1/2003 | Dossett et al. | |
| 2005/0061756 | A1 | 3/2005 | Mattesky | |

OTHER PUBLICATIONS

Written Opinion for PCT/US2005/036318.

* cited by examiner

SHIPPER CONTAINER AND TRANSFER TOOL AND SYSTEM AND METHOD FOR USE THEREOF

This application claims the benefit of U.S. Provisional Application Ser. No. 60/622,974 filed Oct. 28, 2004, which is incorporated herein by reference.

FIELD OF THE INVENTION

One aspect of this invention relates to a device to facilitate the transfer of packaged goods from a shipping container directly to a retail display in a retail outlet. In particular, one aspect of this invention relates to a transfer tool that can be used to remove multiple packages from the shipping container and transfer the multiple packages to a display peg at the retail outlet. Another aspect of this invention relates to a system that includes particular shipping container configurations that facilitate the transfer of the packaged goods from the shipping container to the retail display with the specially designed transfer tool. Yet another aspect of this invention relates to a method to transfer multiple packages from a shipping container to the display peg.

BACKGROUND OF THE INVENTION

In retail stores such as grocery stores, drug stores, convenience stores and "outlet" stores, smaller items can be packaged in sealed plastic or other small packaging for display and ultimate purchase by the consumer. For example, food items, such as processed cheese in shredded form, certain types of lunch or other deli meat, and candy items, are typically packaged in flexible sealed plastic packages. In addition, other items, such as batteries, are typically packaged in more rigid blister type packages. Both of these types of packages typically contain a small hole or opening adjacent to the upper end of the package to allow the packages to be displayed on a peg extending out from a backwall of a display case toward the aisle, and thus the consumer. The consumer can remove a package from the peg for purchase. Once the supply of packages is exhausted, the stock can be resupplied by placing additional packages onto the peg.

Since the margins for these types of retail stores are razor-thin, operators of such stores are constantly looking for ways to decrease their cost of operating the stores. One cost is the labor needed to move retail items from storage and place them onto the display case for consumers to purchase. It is typically time consuming for a stock person to remove the items from a shipping container and to place them on a display case. This is especially difficult when handling large numbers of packages that need to be placed on a peg of a display case. The stock person must align the openings adjacent to the top of the package with the peg and slide the package toward the backwall of the display case. Alignment can be even more difficult because the peg typically has an upturned end. Thus, the stockperson typically places packages on the peg one at a time or only a few at a time. This is inefficient and time consuming. This problem is exacerbated when the need arises to rotate stock, such as the case with food items. Rotation of the stock involves moving the older items to the front of the display peg to ensure those items are sold first and placing the newer stock along the rear of the display peg. To accomplish this, the stock person needs to remove all of the old stock from the display peg, place the new stock on the display peg and then return the old stock to the front of the display peg in front of the old stock. This can become quite a time consuming chore if the packages are placed on the peg one at a time or only a few at a time.

Up to now, there has not been a device that would provide for an efficient method for removing such packages from a shipping container and placing them on a peg in a display case. Nor has there been a shipping container that can be used alone or in combination with such a device to provide a system for efficient shipping and stocking of items on a display peg. Thus, it is an object of this invention to provide a device, system and method to facilitate the quick and efficient transfer of packaged items from a shipping container to a peg on a display case in a retail store or other outlet.

SUMMARY OF THE INVENTION

The transfer tool of this invention includes a handle, a substantially rigid rod extending from the handle, and a peg attachment end. The handle can be formed from any material and in any shape to provide a comfortable location to grasp and manipulate the tool. The rod should be long enough and strong enough to hold a plurality of packages to facilitate the quick transfer of a large number of packages from the shipping container to the display peg. The peg attachment end is configured to temporarily abut the end of the peg extending from the display case and to easily and quickly align the peg and the rod. Preferably the peg attachment end is formed so it has an inwardly extending recess, such as a socket-type configuration, to facilitate placing the end of the rod in abutting contact and alignment with the end of the display peg.

To facilitate the transfer of packages from the shipping container with the transfer tool, the packages to be stocked on the display pegs should be oriented in the shipping container so the openings adjacent to the upper portion of the packages are substantially aligned. This alignment allows the stock person to easily thread the rod of the transfer tool through the openings of a number of packages for transfer to the peg of the display board. The shipping containers, or cartons, of this invention are designed to allow the packages to be placed in the containers lying down yet opened in such a way that the packages are oriented vertically with the openings, adjacent to the upper portion thereof, substantially aligned. This facilitates the placement of the transfer tool through the openings in the packages. One embodiment of the shipping container includes a divider that keeps the rows of packages separate and helps to maintain proper orientation and alignment of the packages.

The method of this invention comprises inserting a substantially rigid rod through the openings adjacent to the tops of a plurality of packages, removing the packages from a shipping container, placing the end of the rigid rod in abutting alignment with the end of the display peg and manipulating the rigid rod or the packages to transfer all of the plurality of packages from the rigid rod to the display peg.

BRIEF DESCRIPTION OF THE DRAWINGS

The preferred embodiments of the present invention are illustrated in the appended drawings in which like reference numbers refer to like elements and in which.

DETAILED DESCRIPTION OF THE INVENTION

Figure 1:
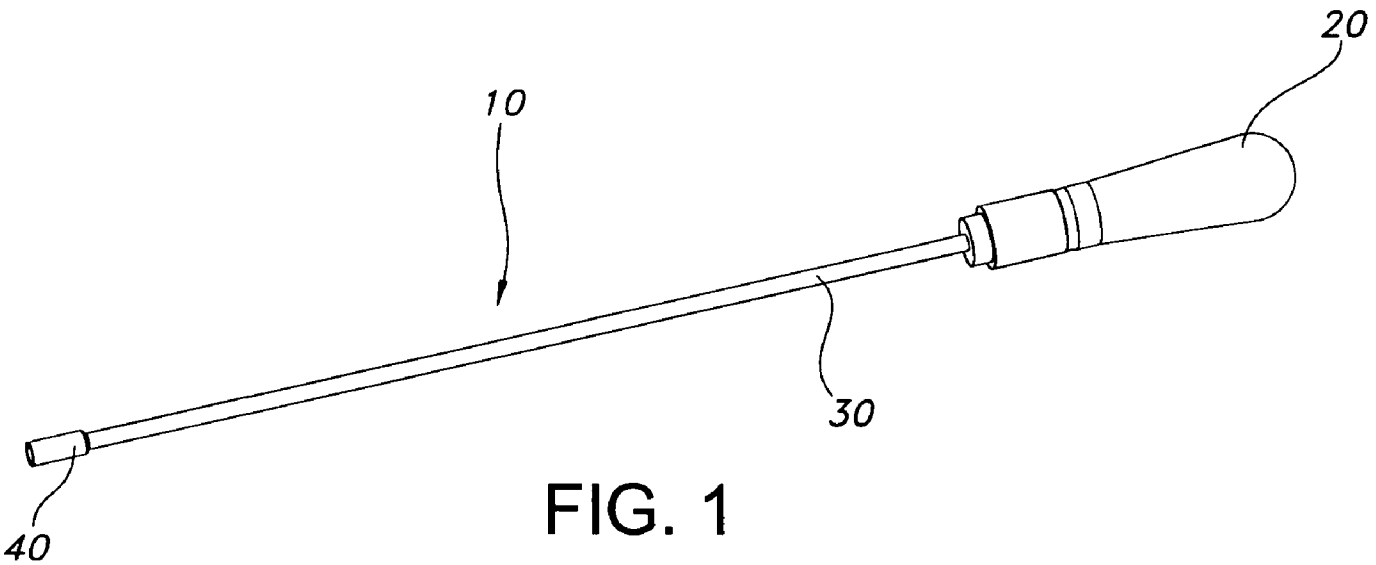
FIG. 1 is a perspective view of one embodiment of the transfer tool.

The transfer tool 10 includes a handle 20, a substantially rigid rod 30 extending from the handle 20, and a peg attachment end 40. See FIG. 1. Transfer tool 10 is preferably sized so it can hold a substantial number of packages to be transferred and can be easily carried and used by a stock person during the stock person's daily activities.

Handle 20 is formed to provide a comfortable location to grasp and manipulate transfer tool 10. Suitable materials for handle 20 include wood, plastic and metal, although other materials could be used that provide a comfortable grasping place for transfer tool 10. Handle 20 can be formed into any desirable shape and preferably has an ergonomic shape, such as a pistol grip, so that transfer tool 10 may be comfortably and easily used.

Rod 30 extends from handle 20. Preferably, rod 30 extends from the distal end of handle 20. Rod 30 is preferably formed from a substantially rigid material, such as chromed steel, although any other suitably strong and rigid material can be used. The type of material used for rod 30 can be chosen by determining the weight of the packages that is desired to be transferred and the strength of a typical stockperson. Rod 30 should be long enough to hold a plurality of packages to facilitate the quick transfer of a large number of packages from the shipping container to the display peg. On the other hand, rod 30 should not be so long that it is unwieldy for the stockperson to manipulate. Rod 30 typically will not be longer than the length of the display peg onto which the packages will be transferred but will preferably be long enough to fit the same number of packages thereon that would be placed on a single display peg. Although the preferred embodiment of this invention includes only one rod 30 extending from handle 20, it is possible to arrange two rods extending from a handle from their proximal ends to allow a stock person to transfer more packages with a single transfer tool.

Peg attachment end 40 is configured to temporarily abut the end of the peg extending from the display case and to facilitate alignment with the display peg. Preferably peg attachment end 40 is formed with a recess at its distal end so as to have a socket-like configuration. This recess or socket-like configuration facilitates placing peg attachment end 40 of rod 30 in abutting contact and alignment with the end of the display peg. In one embodiment, such a socket-like configuration includes an outer wall 41 defining an inner space or recessed portion 42 having a cross section slightly larger than the cross section of the end of the display peg. This slight difference in cross sectional dimensions facilitates the abutment and alignment of peg attachment end 40 with the display peg. This configuration also facilitates temporary attachment of peg attachment end 40 to the end of the display peg. The depth of inner space 42 need only be a dimension sufficient to temporarily locate peg attachment end 40 on and in alignment with the display peg. The distal end of peg attachment end 40 is designed so that the shape facilitates slipping peg attachment end 40 and rod 30 through the openings in the packages and to allow a user to easily place a plurality of packages on rod 30

Peg attachment end 40 is shown in the FIGS. as being aligned with the longitudinal axis of rod 30. However, peg attachment end 40 may also be arranged at an angle to the longitudinal axis of rod 30 to facilitate the transfer of the packages from transfer tool 10 to the display peg. Any suitable angle could be used between peg attachment end 40 and the longitudinal axis of rod 30 as long as the angle does not create an awkward transition for the packages to travel from rod 30 to the display peg.

Figure 2:
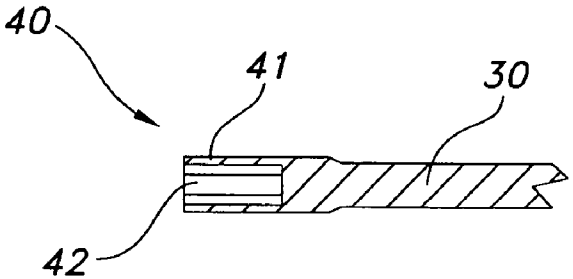
FIG. 2 is an enlarged cross-sectional view of one embodiment of the peg attachment end of the transfer tool.
Figure 3:
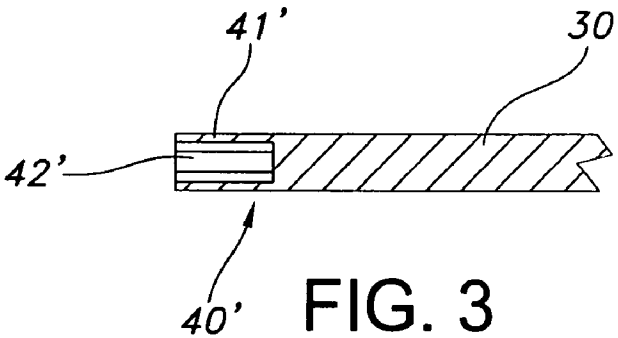
FIG. 3 is an enlarged cross-sectional view of another embodiment of the peg attachment end of the transfer tool.

The outside diameter of peg attachment end 40 should be slightly less than the diameter of the openings 95 located adjacent to the top of the packages 90 that are displayed in a retail outlet display case. As shown in FIG. 2, peg attachment end 40 may have a slightly enlarged cross-section as compared to the remainder of rod 30. In an alternative embodiment for peg attachment end 40 shown in FIG. 3, peg attachment end 40' may have a cross-section substantially the same as rod 30. By having substantially the same cross-section as rod 30, peg attachment end 40' will not hinder the movement of the packages either onto rod 30 or off of rod 30. Of course in certain situations where it is desired to transport the packages with transfer tool 10, having peg attachment end 40 with the larger cross-section will help to prevent inadvertent removal of the packages from rod 30 until the stock person is ready to remove the packages therefrom.

Figure 4A:
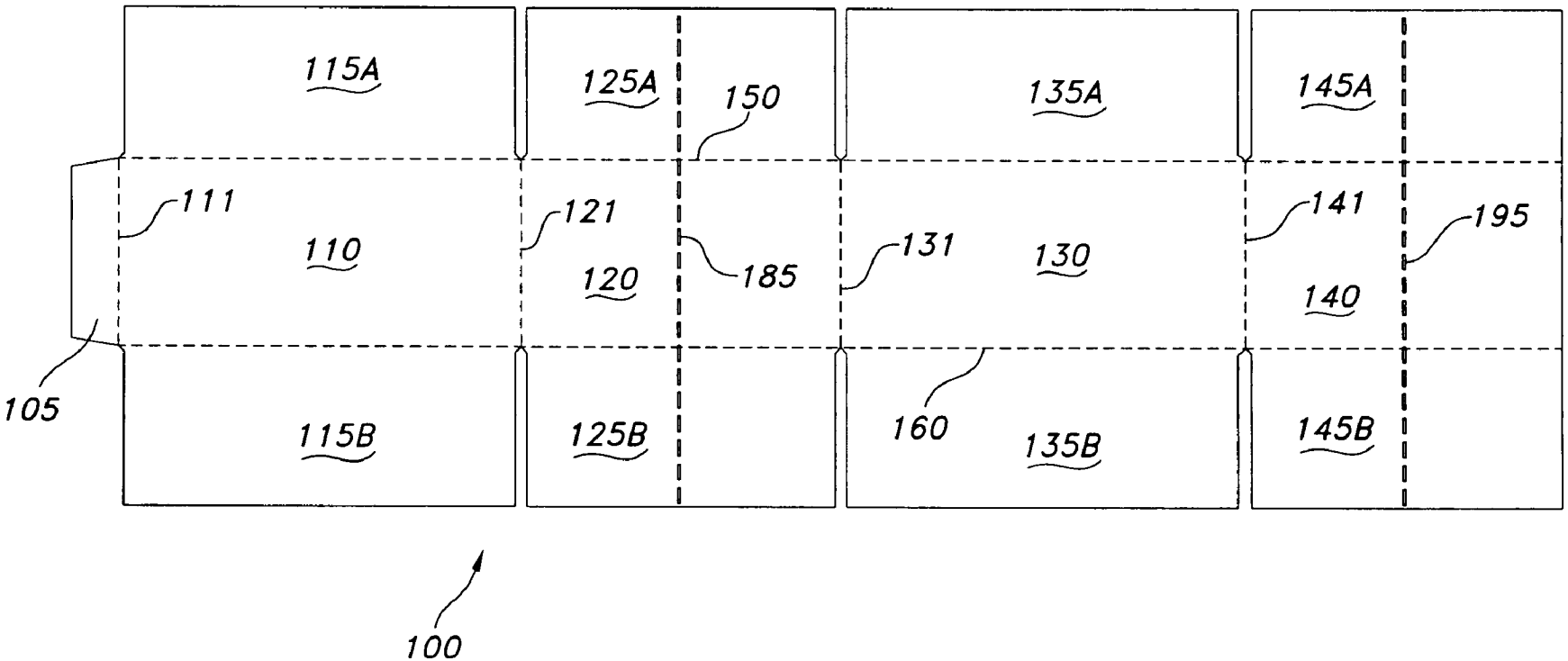
FIG. 4A is a plan view of a first embodiment of a blank for the shipping container that can be used with the transfer tool.

FIG. 4A is a plan view of a paperboard blank 100 that can be used to make a shipping container that is particularly useful in combination with transfer tool 10. Referring to FIG. 4A, paperboard blank 100 incorporates an adhesive tab 105 and four main panels 110, 120, 130 and 140. Adhesive tab 105 is connected along its right edge to the left edge of first main panel 110 along score line 111. First main panel 110 is connected along its right edge to the left edge of second main panel 120 along score line 121. Second main panel 120 is connected along its right edge to the left edge of third main panel 130 along score line 131. Third main panel 130 is connected along its right edge to the left edge of fourth main panel 140 along score line and 141. Each main panel 110, 120, 130, and 140 adjoins a top flap and a bottom flap, wherein the main panels are separated from the top flaps by a top score line 150 extending across the entire blank and the main panels are separated from the bottom flaps by a bottom score line 160 extending across the entire blank. Above first main panel 110 is first top flap 115A. Above second main panel 120 is second top flap 125A. Above third main panel 130 is third top flap 135A. Above fourth main panel 140 is fourth top flap 145A. Below first main panel 110 is first bottom flap 115B. Below second main panel 120 is second bottom flap 125B. Below third main panel 130 is third bottom flap 135B. Below fourth main panel 140 is fourth bottom flap 145B. A first vertical perforation 185 extends from the bottom of second bottom flap 125B through second bottom flap 125B, through second main panel 120 and through second top flap 125A to the top of second top flap 125A at about the midpoint of the width of those elements. Similarly, a second vertical perforation 195 extends from the bottom of fourth bottom flap 145B through fourth bottom flap 145B, through fourth main panel 140 and through fourth top flap 145A to the top of fourth top flap 145A at about the midpoint of the width of those elements. Preferably, a score line extends through second bottom flap 125B instead of a perforation and a score line extends through fourth bottom flap 145B instead of a perforation.

Figure 4B:
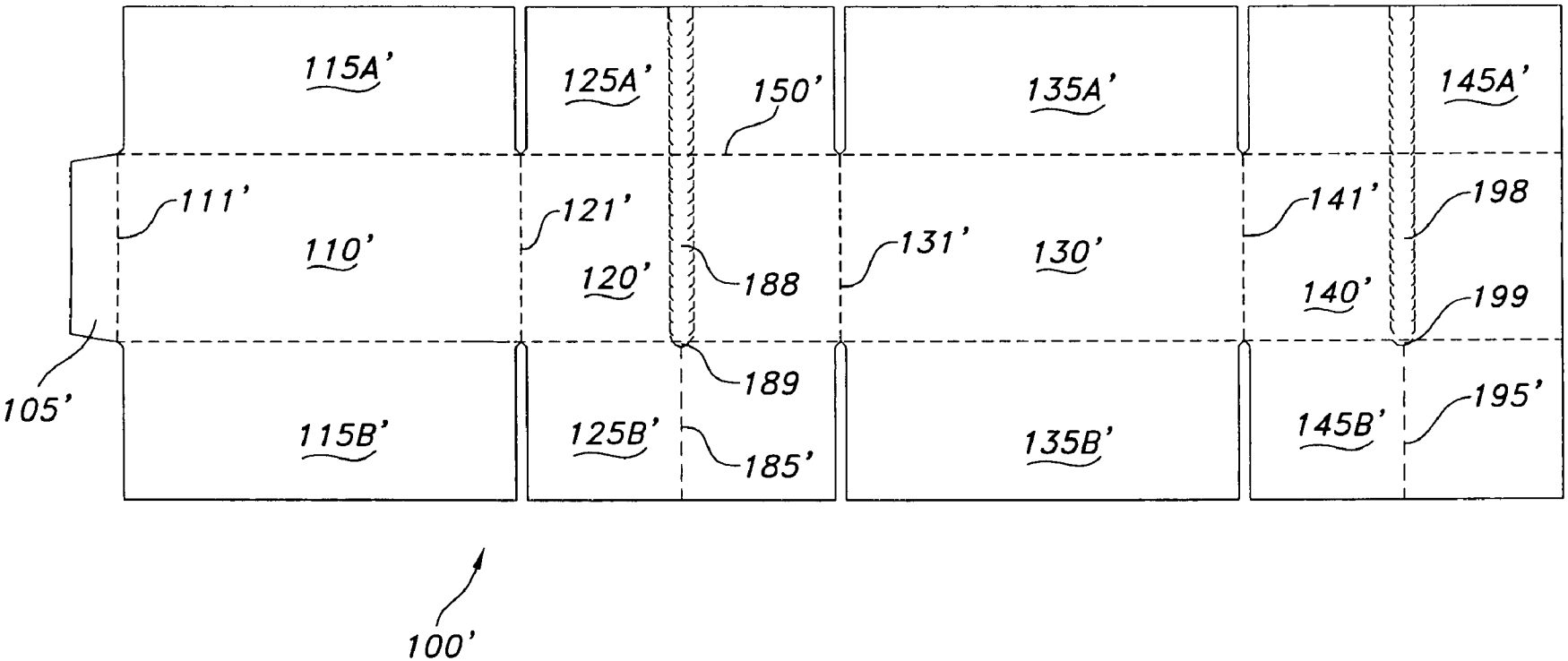
FIG. 4B is a plan view of a modified form of the first embodiment of the blank for the shipping container that can be used with the transfer tool.

A modified form of this blank is shown in FIG. 4B. This blank 100' includes a pair of tear strips that facilitate the opening of the resulting container after it has been shipped to a retail outlet. As seen in FIG. 4B, first tear strip 188 extends from about the junction between second bottom flap 125B' and second main panel 120' through second main panel 120' and second top flap 125A' to the top of second top flap 125A', with first vertical perforation, or preferably score line, 185' extending from the bottom of second bottom flap 125B' to about the junction between second bottom flap 125B' and second main panel 120'. Similarly, a second tear strip 198 extends from about the junction between fourth bottom flap 145B' and fourth main panel 140' through fourth main panel 140' and fourth top flap 145A' to the top of fourth top flap 145A', with second vertical perforation, or preferably score line, 195' extending from the bottom of fourth bottom flap 145B' to about the junction between fourth bottom flap 145B' and fourth main panel 140'. Tear strips 188 and 198 can be formed by standard packaging techniques. For example, this can be done by employing cut lines that define both sides of the tear strips so as to form the outer boundary of the tear strips, with obliquely arranged legs extending into the center portion of the tear strips and where the legs diverge in the direction of the tear of the tear strip. In addition, a tab 189 may be formed at one end of tear strip 188 near the junction between second bottom flap 125B' and second main panel 120' and another tab 199 may be formed at one end of tear strip 198 near the junction between fourth bottom flap 145B' and fourth main panel 140'. Tabs 189 and 199 may be easily grasped by the user to pull off tear strips 188 and 198 respectively to thereby open the container formed from blank 100'.

Figure 5A:
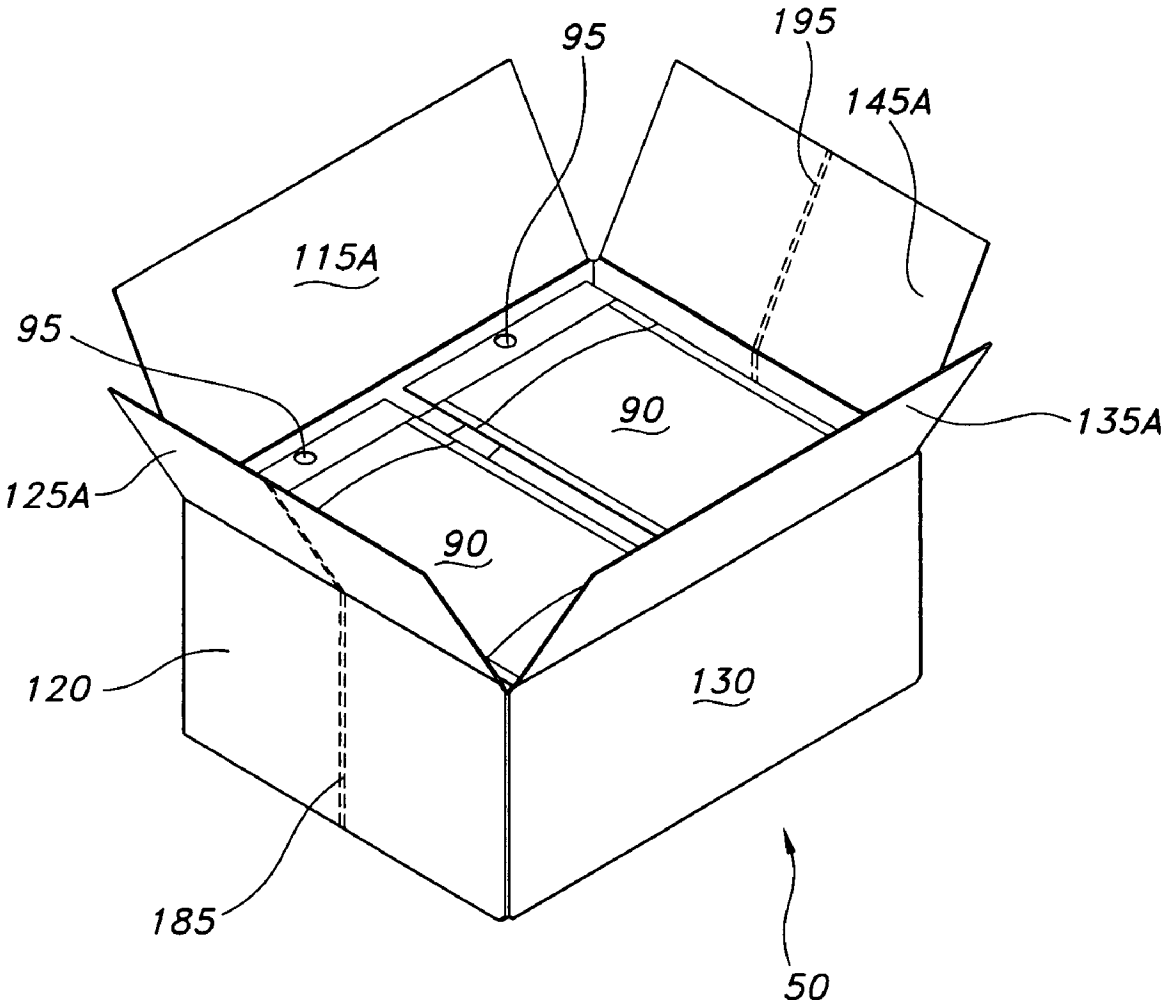
FIG. 5A is a perspective view of a partially erected shipping container made from the first embodiment of the blank of FIG. 4A showing the placement of packages therein for shipment to a retail outlet.
Figure 5B:
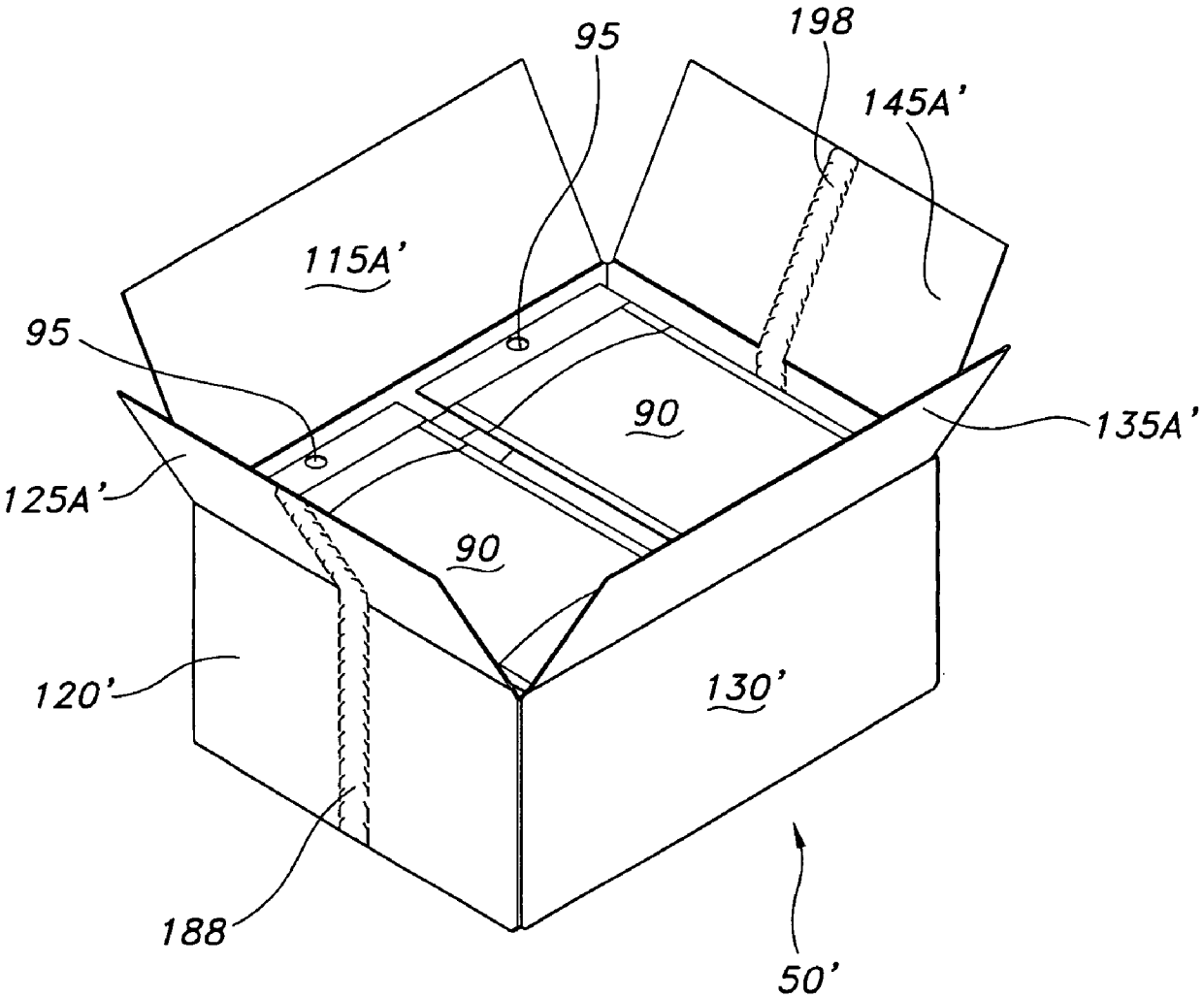
FIG. 5B is a perspective view of a partially erected shipping container made from the modified form of the first embodiment of the blank of FIG. 4B showing the placement of packages therein for shipment to a retail outlet.

To form a container from blank 100, 100', adhesive tab 105, 105' is folded about score line 111, 111' so adhesive tab 105, 105' is generally perpendicular to first main panel 110, 110', which is folded about score line 121, 121' so first main panel 110, 110' is generally perpendicular to second main panel 120, 120', which is folded about score line 131, 131', so second main panel 120, 120' is generally perpendicular to third main panel 130, 130', which is folded about score line 141, 141' so third main panel 130, 130' is generally perpendicular to fourth main panel 140, 140'. This results in adhesive tab 105, 105' being adjacent to the right edge of fourth main panel 140, 140'. Adhesive tab 105, 105' can be adhered to the right portion of fourth main panel 140, 140' by glue or other mechanical adhesive means, such as staples to provide the general configuration for the desired container. Bottom flaps 115B, 115B', 125B, 125B', 135B, 135B' and 145B, 145B' are folded inwardly toward each other and adhered to each other by standard means, such as by glue or other mechanical adhesive means to form a bottom for the desired container. The configuration of such a container 50, 50' at this stage of erection is shown in FIGS. 5A and 5B.

Figure 11:
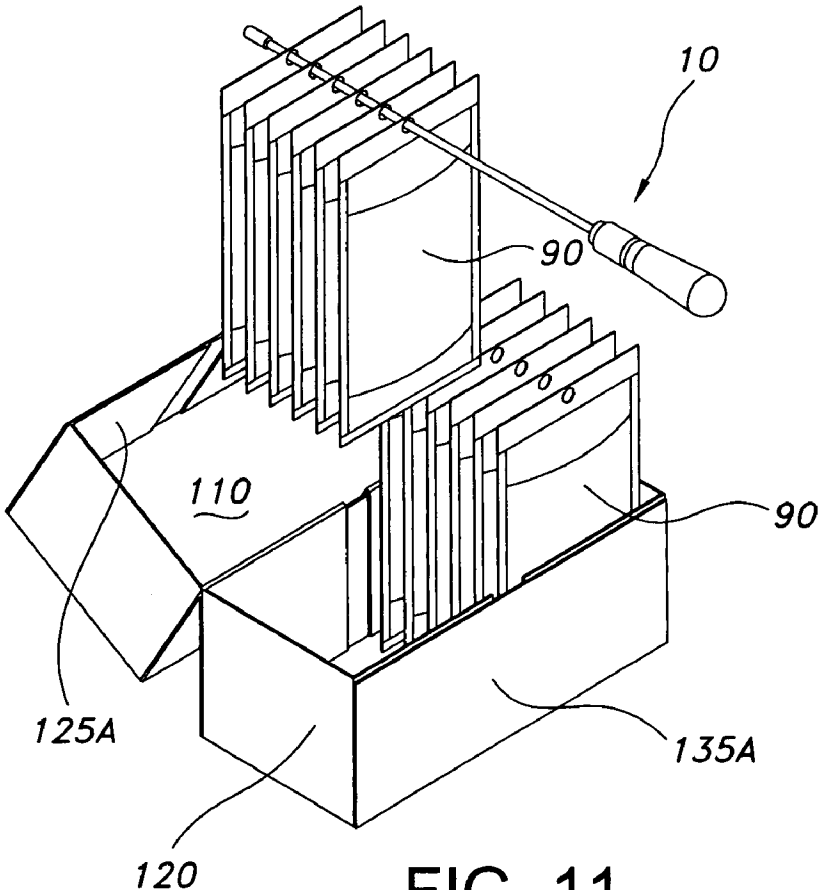
FIGS. 10-14 are perspective views of the transfer tool showing how the transfer tool may be used to remove a plurality of packages from a shipping container and to transfer the packages to the display peg of a display case.
Figure 10:
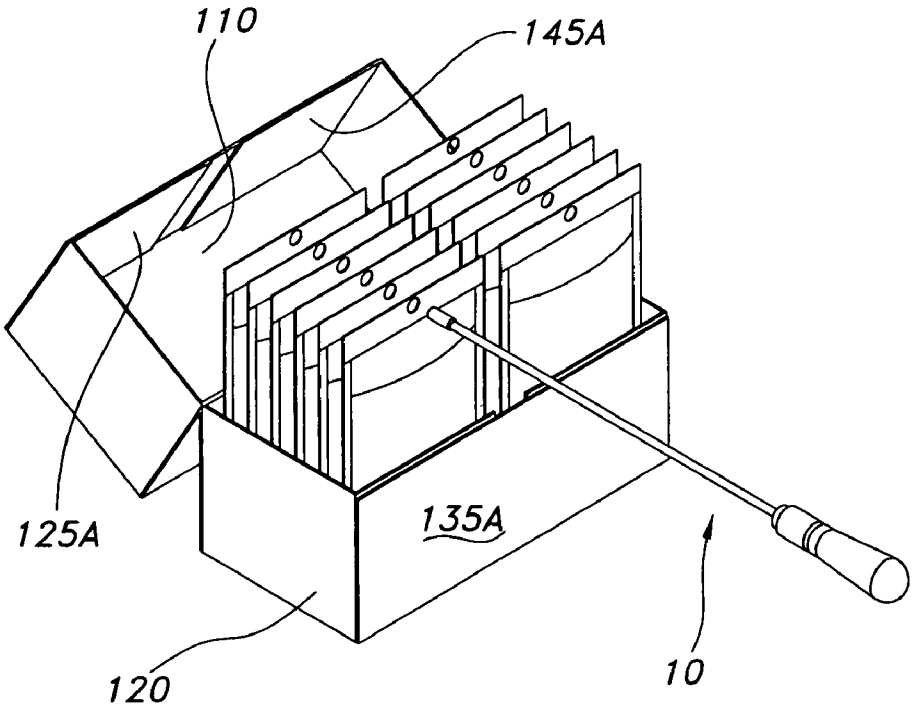
Figure 12:
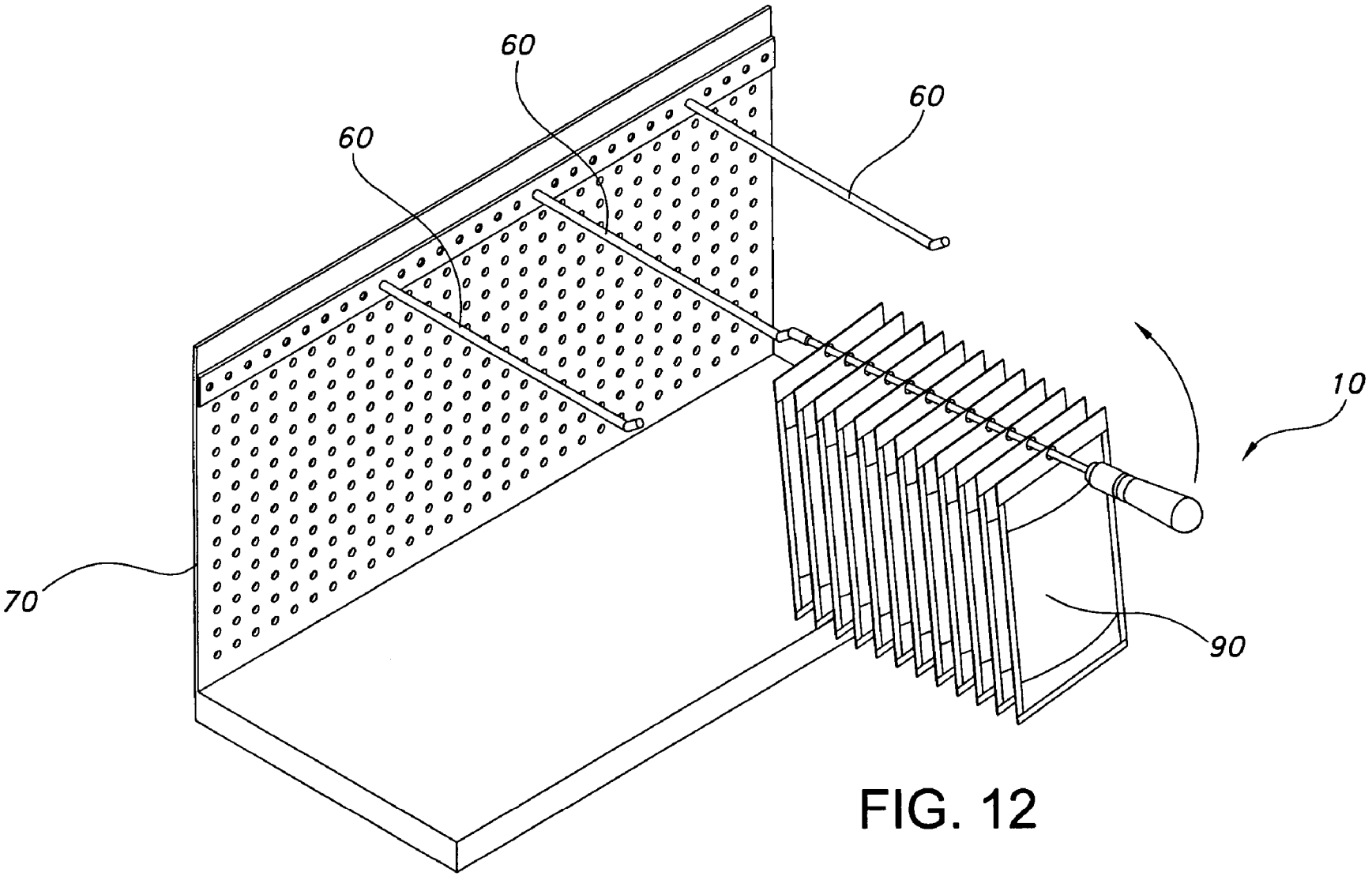
Figure 13:
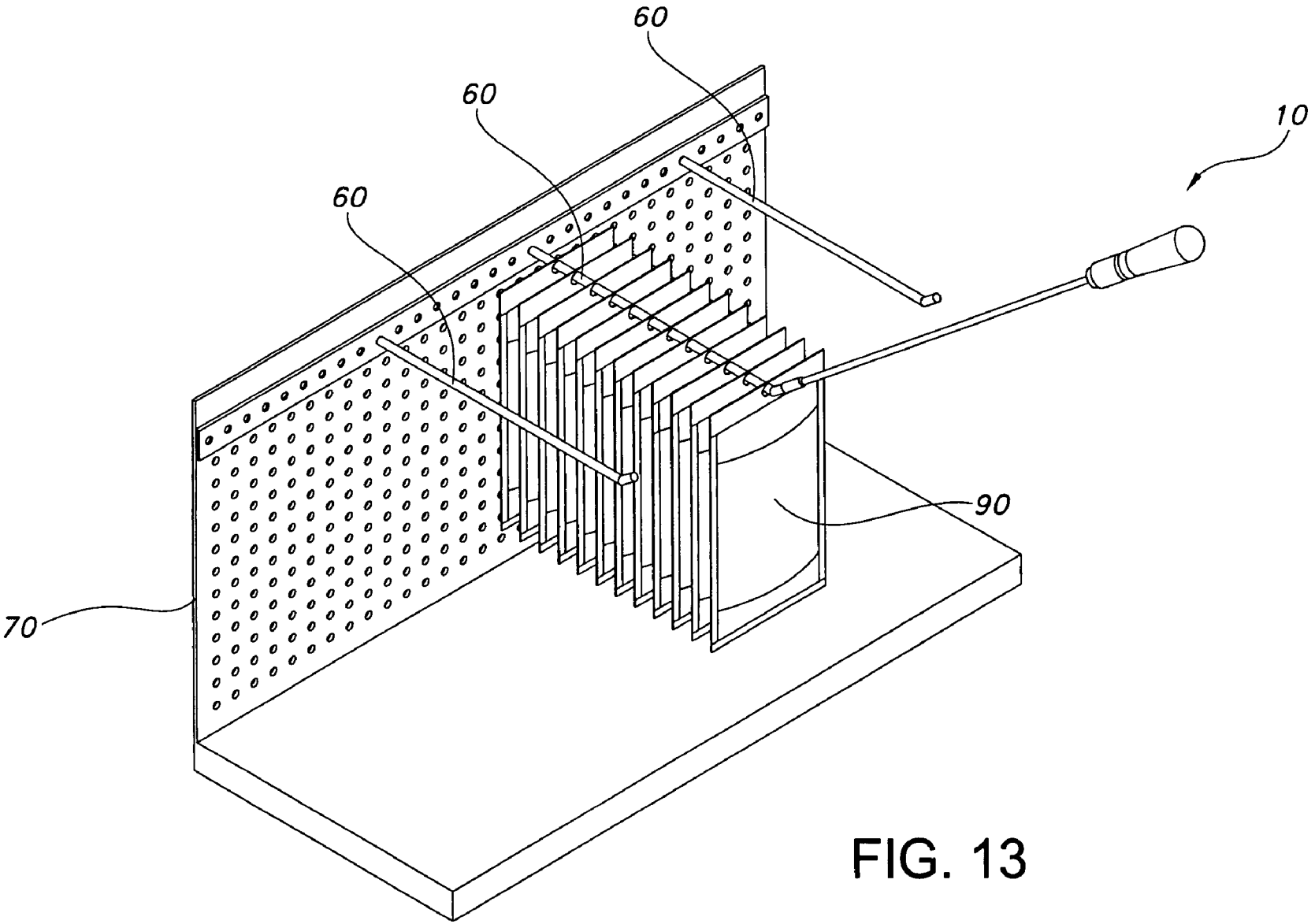
Figure 14:
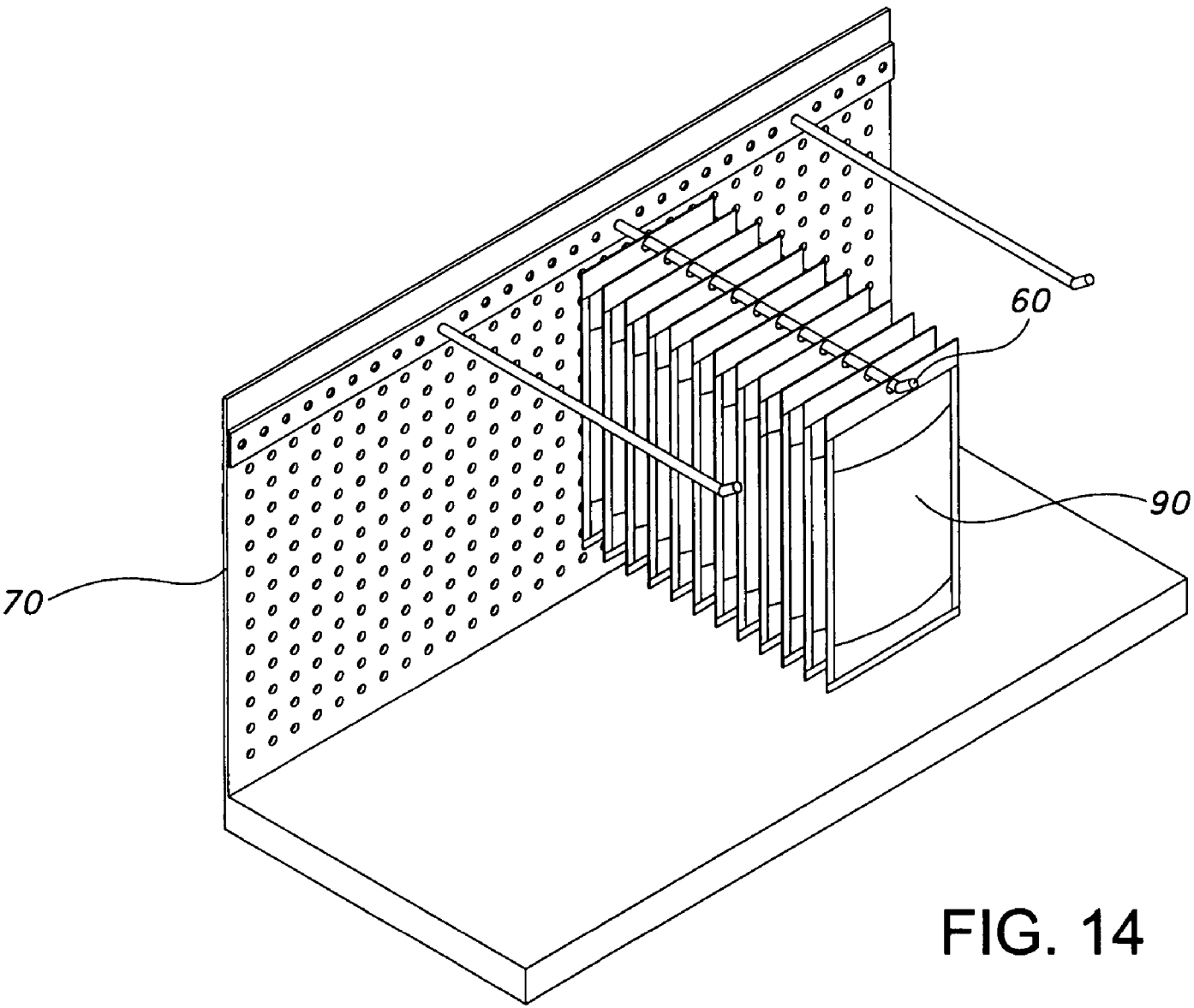

After paperboard blank 100, 100' is folded as discussed above, it is filled with packages 90 to be shipped to a retail outlet. Preferably, packages 90 are arranged so that the openings 95 located adjacent to the top of package 90 are substantially aligned. There can be a single row of packages or multiple rows located in shipping container 50, 50'. The number of rows is not critical as long as there are a number of packages 90 in each row and each of the packages is oriented in each row so that openings 95 are substantially aligned. This alignment facilitates the placement of rod 30 of transfer tool 10 through openings 95 of multiple packages 90 which expedites the transfer of packages 90 from shipping container 50, 50' to the peg 60 of the display stand 70. In order to facilitate this process, packages 90 are placed flat in container 50, 50' as shown in FIGS. 5A and 5B so that the longitudinal axis of packages 90 traverse first and second vertical perforations 185 and 195 or first and second tear strips 188 and 198. Thereafter, top flaps 115A, 115A', 125A, 125A', 135A, 135A' and 145A, 145A' are folded inward toward each other and adhered together by glue or some other conventional adhesive mechanism to provide a closed shipping container 50, 50'. When shipping container 50 arrives at a retail outlet, the stock person can open shipping container 50 by tearing shipping container 50 along first vertical perforation 185 and second vertical perforation 195 but only through the main panels and either the bottom flaps or the top flaps. Shipping container 50' can be easily opened by pulling tabs 188 and 198 to remove tear strips 188 and 198 respectively. With any embodiment of the shipping container, opening the shipping container as set forth above will allow the shipping container to have a bottom portion that is hinged to a top portion about the mid-portions of second bottom flap 125B, 125B' and fourth bottom flap 145B, 145B' where perforations, or preferably score lines, 185, 185' and 195, 195', respectively, are located. Thus, as seen in FIGS. 10 and 11, when the shipping container is placed on a horizontal surface, the shipping container opens so that packages 90 are oriented vertically with openings 95 substantially aligned to facilitate the insertion of rod 30 through a plurality of openings 95 substantially simultaneously.

Figure 6:
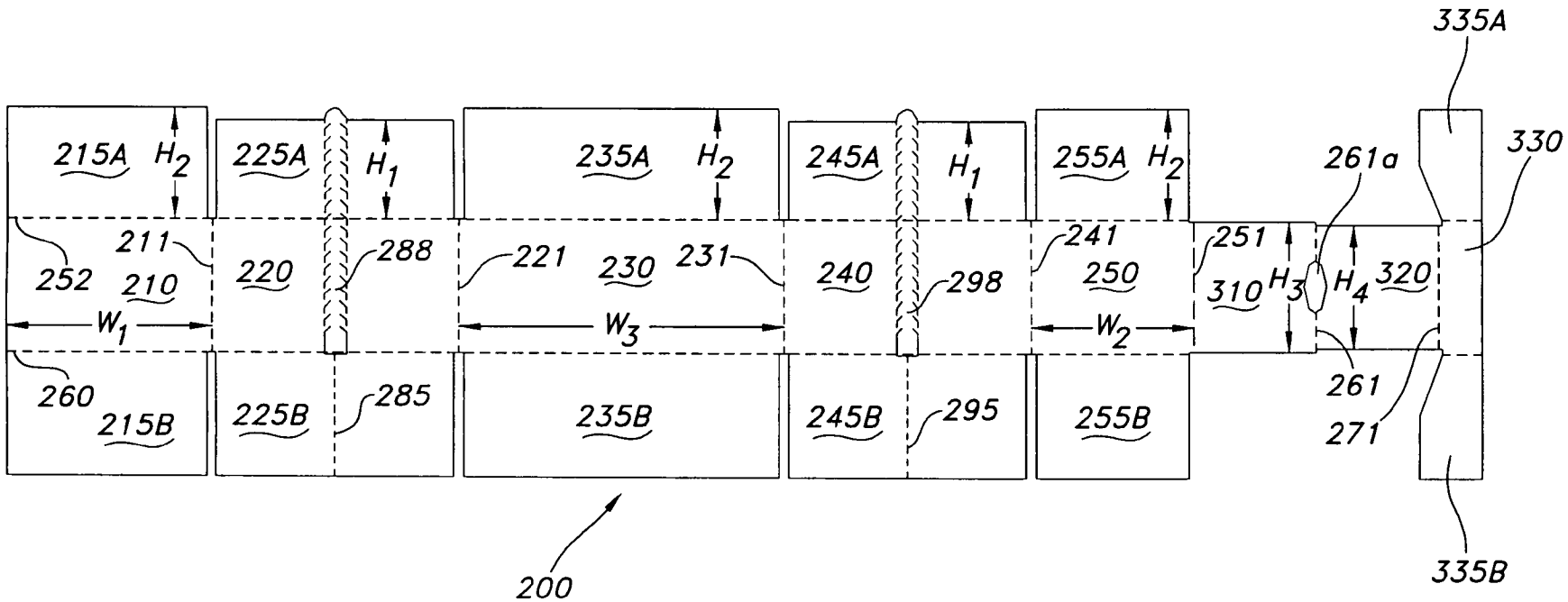
FIG. 6 is a plan view of a second embodiment of a blank for the shipping container that can be used with the transfer tool.

FIG. 6 is a plan view of a paperboard blank 200 that can be used to make a shipping container that includes a divider and that is particularly well suited for use in combination with transfer tool 10. Referring to FIG. 6, paperboard blank 200 includes five main panels 210, 220, 230, 240 and 250. First main panel 210 is connected along its right edge to the left edge of second main panel 220 along score line 211. Second main panel 220 is connected along its right edge to the left edge of third main panel 230 along score line 221. Third main panel 230 is connected along its right edge to the left edge of fourth main panel 240 along score line 231. Fourth main panel 240 is connected along its right edge to the left edge of fifth main panel 250 along score line 241. Each main panel 210, 220, 230, 240 and 250 adjoins a top flap and a bottom flap, wherein the main panels are separated from the top flaps by a top score line 252 extending across the entire blank and the main panels are separated from the bottom flaps by a bottom score line 260 extending across the entire blank. Above first main panel 210 is first top flap 215A. Above second main panel 220 is second top flap 225A. Above third main panel 230 is third top flap 235A. Above fourth main panel 240 is fourth top flap 245A. Above fifth main panel 250 is fifth top flap 255A. Below first main panel 210 is first bottom flap 215B. Below second main panel 220 is second bottom flap 225B. Below third main panel 230 is third bottom flap 235B. Below fourth main panel 240 is fourth bottom flap 245B. Below fifth main panel 250 is fifth bottom flap 255B. A first vertical perforation, or preferably score line, 285 extends from the bottom of second bottom flap 225B through second bottom flap 225B to the junction with second main panel 220. A first tear strip 288 extends from about the junction between second bottom flap 225B and second main panel 220 through second main panel 220 and second top flap 225A to the top of second top flap 225A. Both first vertical perforation, or preferably score line, 285 and first tear strip 288 are located at about the midpoint of the width of the elements through which they extend. Similarly, a second vertical perforation, or preferably score line, 295 extends from the bottom of fourth bottom flap 245B through fourth bottom flap 245B to the junction with fourth main panel 240. A second tear strip 298 extends from about the junction between fourth bottom flap 245B and fourth main panel 240 through fourth main panel 240 and fourth top flap 245A to the top of fourth top flap 245A. Both second vertical perforation, or preferably score line, 295 and second tear strip 298 are located at about the midpoint of the width of the elements through which they extend.

Tear strips 288 and 298 can be formed by standard packaging techniques, such as by employing cut lines that define both sides of the tear strips so as to form the outer boundary of the tear strips with obliquely arranged legs extending into the center portion of the tear strips and that diverge in the direction of the tear of the tear strip. Preferably, the tops of tear strips 288 and 298 extend beyond the tops of second top flap 225A and fourth top flap 245A respectively. This allows tear strips 288 and 298 to be easily grasped by the user to pull off tear strips 288 and 298 to thereby open the container formed from blank 200. One way to have the tops of tear strips 288 and 298 extend beyond the tops of second top flap 225A and fourth top flap 245A is to have the height ("H1") of second top flap 225A and fourth top flap 245A to be slightly less than the height ("H2") of first top flap 215A, third top flap 235A and fifth top flap 255A. This is the preferred mechanism in order to minimize waste when forming blank 200. However, alternatively, the height ("H1") of second top flap 225A and fourth top flap 245A can be substantially equal to the height ("H2") of first top flap 215A, third top flap 235A and fifth top flap 255A with the ends of tear strips 288 and 298 extending beyond the tops of second top flap 225A and fourth top flap 245A respectively.

Extending from fifth main panel 250 is a first divider 310, a second divider 320 and a glue tab 330. First divider 310 is connected along its left side to the right side of fifth main panel 250 along a score line 251, second divider 320 is connected along its left side to the right side of first divider 310 along a score line 261 defining an opening 261*a* therein and glue tab 330 is connected along a generally central portion of its left side to the right side of second divider 320 along a score line 271. Preferably, first divider 310 has a height ("H3") that is greater than the height ("H4") of second divider 320. Glue tab 330 has an upper portion 335A that is adhered to third top flap 235A and a bottom portion 335B that is adhered to third bottom flap 235B when a shipping container made from blank 200 is formed. The difference in height of first divider 310 and second divider 320 ("H3–H4") should be about equal to the sum of the thickness of the material used to form upper portion 335A and bottom portion 335B of glue tab 330. Second divider 320 should be located adjacent to first divider 310 so that (i) one-half of the difference in height ("H3–H4") is located between the top of second divider 320 and the top of first divider 310, and (ii) one-half of the difference in height ("H3–H4") is located between the bottom of second divider 320 and the bottom of first divider 310. This will allow the top of the resulting container to lay flat because the extra space afforded by the narrower second divider will provide a place for upper portion 335A and bottom portion 335B of glue tab 330 to reside after third bottom flap 235B and third top flap 235A are folded over when the container is assembled from blank 200.

Figure 7:
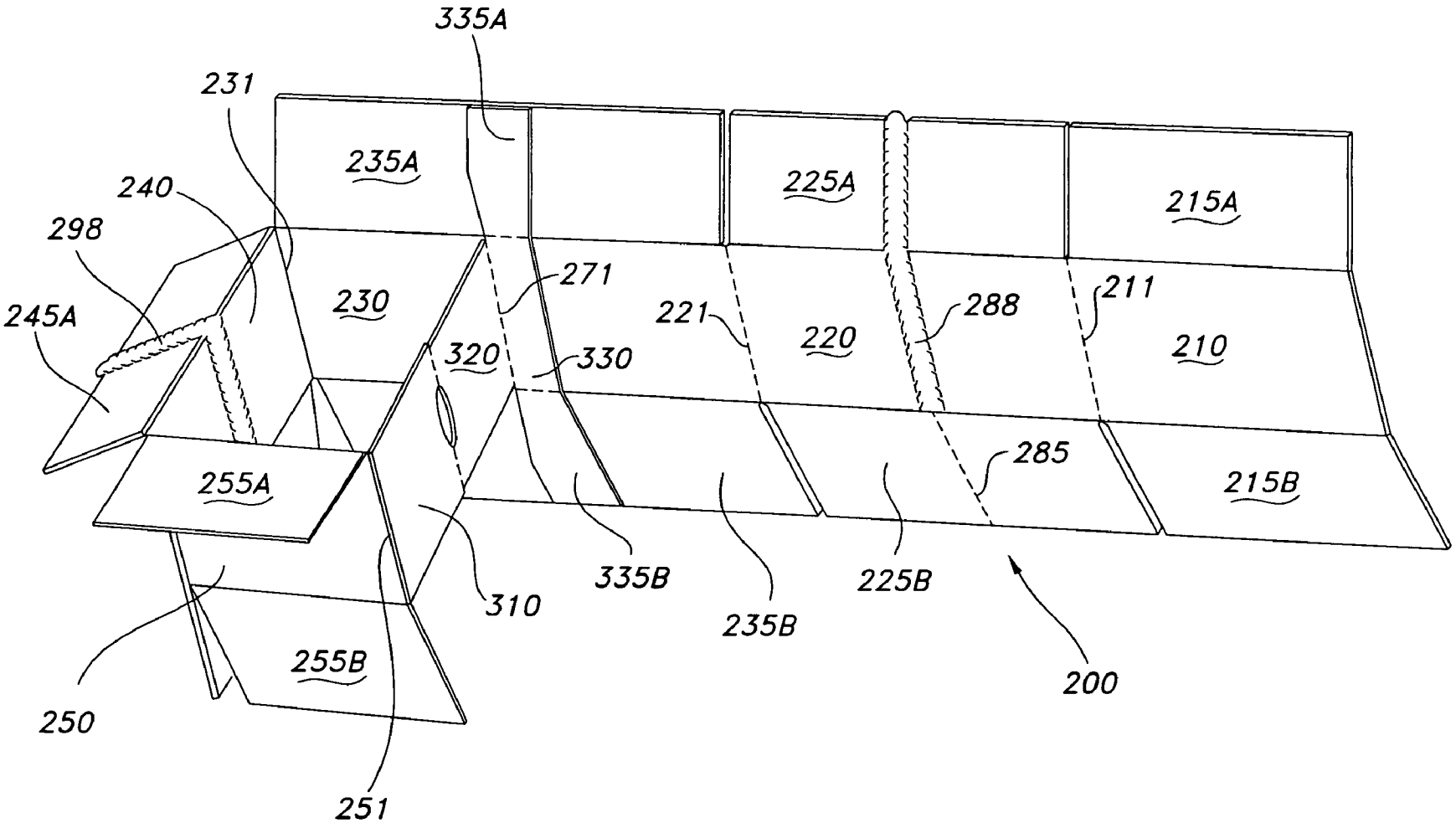
FIG. 7 is a perspective view of the second embodiment of the blank of FIG. 6 partially folded to create a shipping container.

To form a container from blank 200, glue tab 330 is folded along score line 271 so glue tab 330 is perpendicular to second divider 320. First divider 310 is then folded along score line 251 in the opposite direction so first divider 310 is perpendicular to fifth main panel 250, which extends in an opposite direction from glue tab 330. Fifth main panel 250 is folded along score line 241 so fifth main panel 250 is perpendicular to fourth main panel 240, which is generally parallel to and extends in the same direction as first and second dividers 310 and 320. Fourth main panel 240 is folded along score line 231 so fourth main panel 240 is perpendicular to third main panel 230, which is generally parallel to and extends in the same direction as fifth main panel 250. Note that in FIG. 7 blank 200 is reoriented from the view shown in FIG. 6, i.e. the blank of FIG. 6 has been flipped over with the right edge of glue tab 330 as the axis of rotation. Preferably, the width ("W2") of fifth main panel 250 is substantially equal to one-half the width ("W3") of third main panel 230. With these dimensions, glue tab 330 is adjacent to third main panel 230 along about the middle portion thereof when blank 200 has been folded as described above and as shown in FIG. 7. Glue tab 330 may be adhered to third main panel 230 by any suitable adhesive means, such as glue. In addition, upper portion 335A may be adhered to third top flap 235A by any suitable adhesive means, such as glue, along about the middle portion thereof, and bottom portion 335B may be adhered to third bottom flap 235B by any suitable adhesive means, such as glue, along about the middle portion thereof.

Thereafter, first main panel 210 is folded about score line 211 so first main panel 210 is generally perpendicular to second main panel 220, which is folded about score line 221 so second main panel 220 is generally perpendicular to third main panel 230. This results in fifth main panel 250 and first main panel 210 to be adjacent to each other. The width ("W3") of third main panel is slightly less than the sum of the widths ("W1" and "W2") of first main panel 210 and fifth main panel 250. This slight difference in dimensions ensures that when first main panel 210 and fifth main panel 250 overlap by this difference in dimension, the resulting container with have sides that are substantially equal. The overlapped portions of first main panel 210 and fifth main panel 250 can be adhered together by glue or other mechanical adhesive means, such as staples. This results in the general configuration of the desired container. Bottom flaps 215B, 225B, 235B, 245B and 255B are then folded inwardly toward each other and adhered to each other by standard means, such as by glue or other mechanical adhesive means to form a bottom for the desired container. The configuration of such a container 500 at this stage of erection is shown in FIG. 8.

Figure 8:
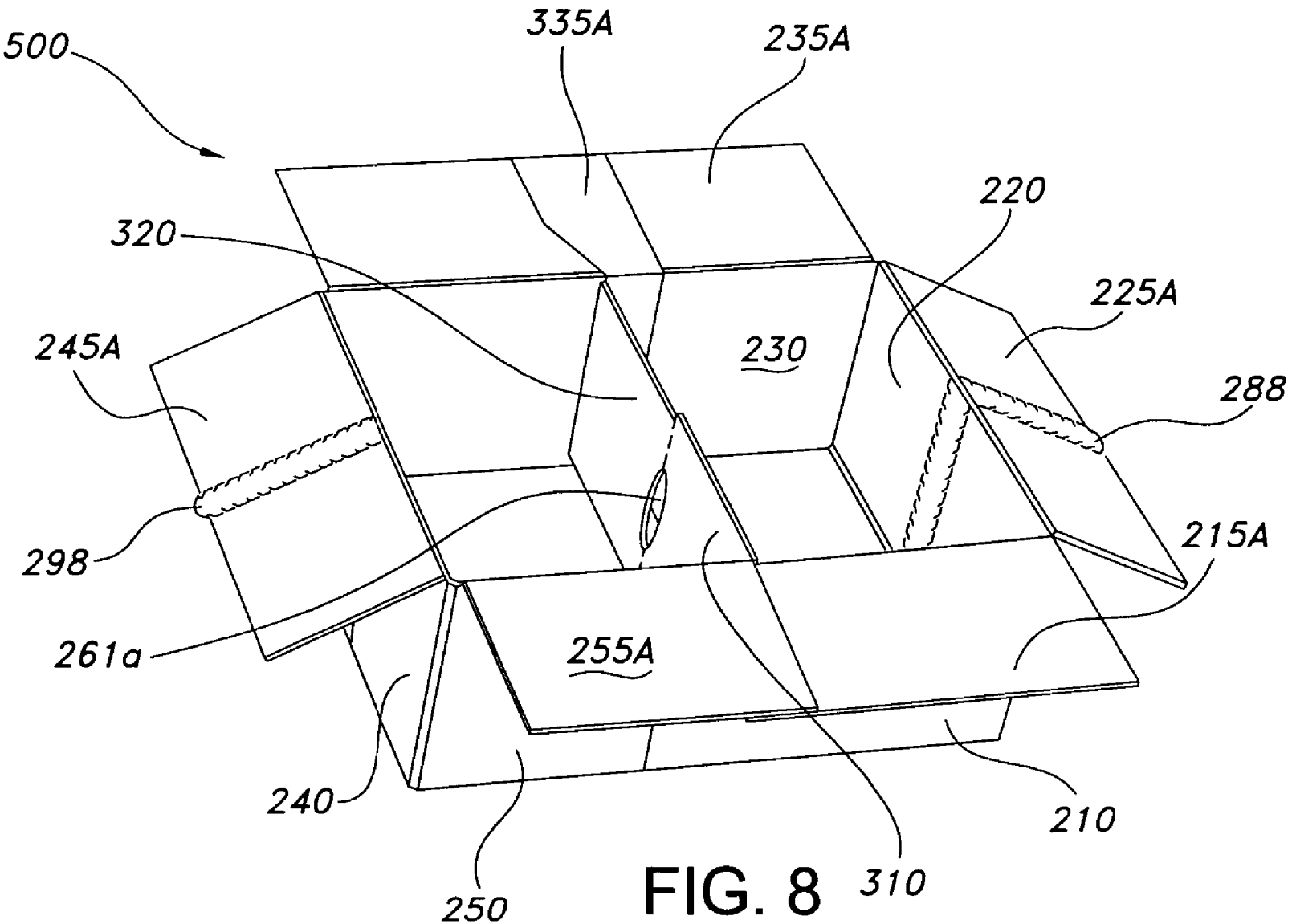
FIG. 8 is a perspective view of a partially erected shipping container made from the second embodiment of the blank of FIG. 6.
Figure 9:
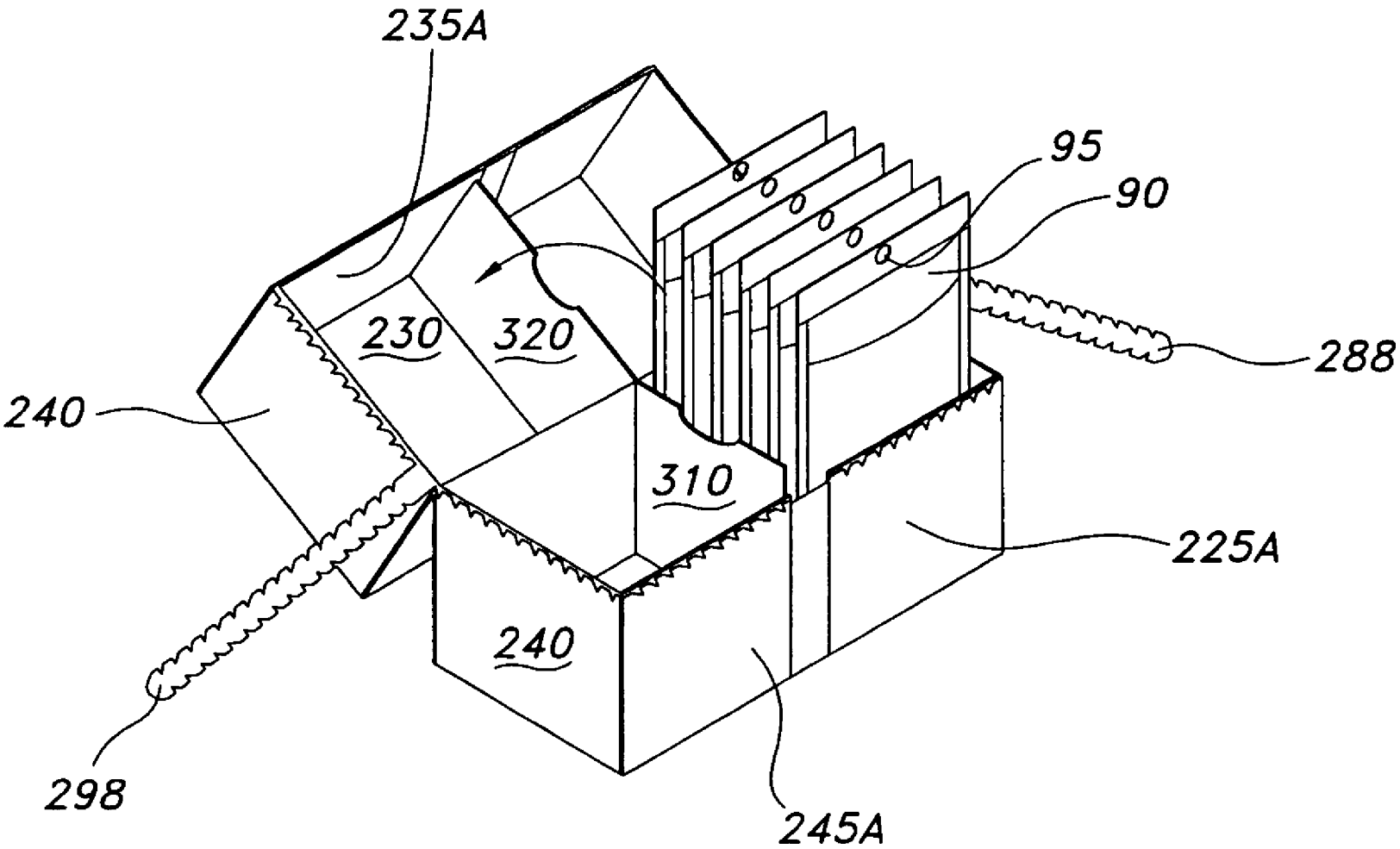
FIG. 9 is a perspective view of the shipping container formed from the second embodiment of a blank shown in FIG. 6 after it has been opened at the retail outlet with the packages therein aligned for movement to a display peg with the use of the transfer tool.

As shown in FIG. 8, the configuration for container 500 provides a divider, 310 and 320, for two rows of packages that will be shipped in the resulting container and prevents the packages from interleaving during shipment. As seen in FIG. 8, upper portion 335A of glue tab 330 is adhered to third top flap 235A such that upper portion 335A of glue tab 330 would extend across the top of second divider 320 when third top flap 235A is closed over second divider 320. Since second divider 320 has a smaller height than first divider 310, third top flap 235A will still close flat and be substantially aligned with first top flap 215A. Since the left edge of first divider 310 is connected to the right edge of fifth main panel 250, as seen in FIG. 6, fifth top flap 255A can be folded over as part of the top of the container so the resulting top surface is even with the top of first divider 310 and first top flap 215A will be even with top third flap 235A when they are both folded over as part of the top of the container. The analogous configuration occurs with respect to bottom portion 335B of glue tab 330 and the bottom of second divider 320 as well as fifth bottom flap 255B and first bottom flap 215B.

The method of this invention comprises inserting rod 30 through openings 95 in a plurality of packages 90, removing packages 90 from shipping container 50, 50', or 500 placing peg attachment end 40, 40' of rod 30 in abutting alignment with the end of display peg 60 and manipulating transfer tool 10, and thus rod 30, to transfer all of the plurality of packages 90 from rod 30 to display peg 60. See FIGS. 10 through 14. With transfer tool 10 of this invention, the foregoing method can be accomplished with only one hand since the stock person does not necessarily need to use both hands to align the end of display peg 60 with peg attachment end 40.

The shipping container containing a plurality of packages 90 for display at a retail store, should be opened along a plane that is roughly parallel to the width of the third main flap. For container 50, this is roughly parallel to the plane defined by first vertical perforation 185 and second vertical perforation 195. For container 50', this is roughly parallel to the plane defined by first tear strip 188 and second tear strip 198. For container 500, this is roughly parallel to the plane defined by first tear strip 288 and second tear strip 298. In container 500, first divider 310 tears from second divider 320 along score line 261. Opening 261*a* facilitates the splitting apart of first divider 310 and second divider 320.

After the shipping container containing a plurality of packages 90 for display at a retail store location has been opened, peg attachment end 40 is moved through openings 95 in a plurality of packages 90 so that they rest on rod 30. Any number of packages 90 can be placed on rod 30, the only limitation being the strength of transfer tool 10 and the stock person and the size of packages 90. Having openings 95 of packages 90 substantially in alignment facilitates this task. See FIGS. 10 and 11. Then, peg attachment end 40 is placed on the end of display peg 60 to place rod 30 into alignment with display peg 60. See FIG. 12. This maneuver can be accomplished by the stock person with only one hand since the recessed portion 42 of peg attachment end 40 provides a self guiding tool. Once peg attachment end 40 is placed at the end of display peg 60, transfer tool 10 can be manipulated, such as by placing transfer tool 10 at an incline and, if necessary, shaking transfer tool 10 or manually moving packages 90 off of rod 30, to transfer the plurality of packages 90 to display peg 60. See FIGS. 12 through 14. Thereafter, the stockperson can identify additional packages to transfer from a shipping container to a display case and repeat the process. In order to rotate stock, peg attachment end 40 is placed at the end of display peg 60 and all of the old stock on display peg 60 is moved onto rod 30. This old stock can then be removed from rod 30 and placed in an adjacent location for restocking. The new stock can be added to display peg 60 as described above. Thereafter, the old stock can be retrieved and placed on rod 30. Peg attachment end 40 is then placed at the end of display peg 60 whereupon the old stock can be transferred to display peg 60. This ensures that the old stock is located at the front of display peg 60 to ensure that the old stock is sold first.

It has been found that the use of transfer tool 10 of the present invention can substantially cut the time it would normally take a stock person to transfer a plurality of packages from a shipping container to a display case. For a normal shipping container of shredded cheese a stock person using the invention can transfer the contents of the shipping container to a display peg in almost half of the time it would normally take that stock person to complete the task by hand. This time savings can be maximized and improved when shipping container 50, 50' or 500 is used such that the packages are shipped so the openings adjacent to the tops of the packages are in substantial alignment.

Thus it is seen that a transfer tool and shipping container are provided that facilitates the transfer of a plurality of packages from the shipping container to a display peg.

We claim:

1. A shipping container comprising:

first and second opposing side panels, each side panel including a front edge, a back edge, a top edge and a bottom edge;

a back panel joined along opposite sides to the side panels, the back panel defining a first edge and a second edge, each of the first edge of the back panel and the second edge of the back panel adjoining one of the pair of opposing side panels along a back edge thereof;

a front panel joined along opposite sides to the side panels, the front panel defining a first edge and a second edge, each of the first edge of the front panel and the second edge of the front panel adjoining one of the pair of opposing side panels along a front edge thereof;

first and second top panels adjoining each of the first and second side panels respectively along the top edges thereof;

first and second bottom panels adjoining each of the first and second side panels along the bottom edges thereof;

a divider integral with the shipping container and having a first portion extending from the front panel and a second portion extending from the back panel, the first portion of the divider adjoining the second portion of the divider along a score line extending substantially parallel to the front panel at about a midpoint between the front panel and the back panel;

wherein the first side panel, the first top panel and the first bottom panel define a first substantially continuous perforation and the second side panel, the second top panel and the second bottom panel define a second substantially continuous perforation along which the shipping carton can be split into two portions where at least one portion is adapted to hold in a substantially vertical orientation a plurality of packages each with a top portion and an opening adjacent to the top portion such that the openings are substantially aligned.

2. The shipping carton of claim 1, wherein the first substantially continuous perforation includes a first tear strip extending along the first side panel and the first top panel.

3. The shipping carton of claim 2, wherein the second substantially continuous perforation includes a second tear strip extending along the second side panel and the second top panel.

4. The shipping carton of claim 1, wherein the first portion of the divider has a first height and the second portion of the divider has a second height and wherein the first height is greater than the second height.

5. The shipping carton of claim 1, wherein the divider has a first portion and a second portion separated by an opening and at least one score line.

6. A blank for forming a shipping container, comprising:

a first main panel having a right edge, a left edge, a top edge and a bottom edge;

a second main panel having a right edge, a left edge, a top edge and a bottom edge, the first main panel connected along its right edge to the left edge of the second main panel;

a third main panel having a right edge, a left edge, a top edge and a bottom edge, the second main panel connected along its right edge to the left edge of the third main panel;

a fourth main panel having a right edge, a left edge, a top edge and a bottom edge, the third main panel connected along its right edge to the left edge of the fourth main panel;

a fifth main panel having a right edge, a left edge, a top edge and a bottom edge, the fourth main panel connected along its right edge to the left edge of the fifth main panel;

a first top flap adjoining the top edge of the first main panel;

a second top flap adjoining the top edge of the second main panel;

a third top flap adjoining the top edge of the third main panel;

a fourth top flap adjoining the top edge of the fourth main panel;

a fifth top flap adjoining the top edge of the fifth main panel;

a first bottom flap adjoining the bottom edge of the first main panel;

a second bottom flap adjoining the bottom edge of the second main panel;

a third bottom flap adjoining the bottom edge of the third main panel;

a fourth bottom flap adjoining the bottom edge of the fourth main panel;

a fifth bottom flap adjoining the bottom edge of the fifth main panel;

a first divider having a right edge and a left edge, the first divider connected along its left edge to the right edge of the fifth main panel;

a second divider having a right edge and a left edge, the second divider connected along its left edge to at least a portion of the right edge of the first divider;

a first tear strip extending through the second main panel and the second top flap; and a glue tab having a right edge and a left edge, the glue tab connected along at least a portion of its left edge to the right edge of the second divider.

7. The blank of claim 6, wherein the first divider has a first height and the second divider has a second height and wherein the first height is greater than the second height.

8. The blank of claim 7, wherein the glue tab defines a thickness and the difference between the first height and the second height is about equal to twice the thickness of the glue tab.

9. The blank of claim 6, wherein the first tear strip is located at about the midpoint of the width of the second main panel and the second top flap.

10. The blank of claim 6, further comprising a second tear strip extending through the fourth main panel and the fourth top flap.

11. The blank of claim 10, wherein the second tear strip is located at about the midpoint of the width of the fourth main panel and the fourth top flap.

12. The blank of claim 10, wherein the second top flap has a top edge and the first tear strip extends beyond the top edge of second top flap and the fourth top flap has a top edge and the second tear strip extends beyond the top of the fourth top flap.

13. The blank of claim 12, wherein the second top flap and the fourth top flap each have a height that is less than the height of the first top flap and the third top flap.

14. The shipping carton of claim 6, wherein the first divider is connected to the second divider along a score line.

15. The shipping carton of claim 14, wherein the first divider and the second divider are separated by an opening and at least one score line.

* * * * *